US012089744B2

(12) United States Patent
Zhao et al.

(10) Patent No.: US 12,089,744 B2
(45) Date of Patent: Sep. 17, 2024

(54) FURNITURE ASSEMBLY WITH RECLINER MODULE

(71) Applicant: Cushy Holdings, Inc., San Diego, CA (US)

(72) Inventors: Zelong Zhao, Beijing (CN); Yinxiang Shi, Huzhou (CN); Jun Yang, Huzhou (CN)

(73) Assignee: Cushy Holdings, Inc., San Diego, CA (US)

( * ) Notice: Subject to any disclaimer, the term of this patent is extended or adjusted under 35 U.S.C. 154(b) by 52 days.

(21) Appl. No.: 17/702,758

(22) Filed: Mar. 23, 2022

(65) Prior Publication Data

US 2023/0066786 A1 Mar. 2, 2023

(30) Foreign Application Priority Data

Aug. 26, 2021 (CN) ..... 202122034132.4
Aug. 26, 2021 (CN) ..... 202122039419.6

(51) Int. Cl.
*A47C 13/00* (2006.01)
*A47C 17/04* (2006.01)
*A47C 17/34* (2006.01)

(52) U.S. Cl.
CPC ..... *A47C 13/005* (2013.01); *A47C 17/04* (2013.01); *A47C 17/34* (2013.01)

(58) Field of Classification Search
CPC ..... A47C 13/005; A47C 17/04; A47C 17/34; A47C 19/005
USPC ..... 297/440.1
See application file for complete search history.

(56) References Cited

U.S. PATENT DOCUMENTS

| | | | | |
|---|---|---|---|---|
| 5,360,255 | A | 11/1994 | Cook | |
| 5,630,644 | A | 5/1997 | LaPointe | |
| 7,213,885 | B2 | 5/2007 | White, III | |
| 7,419,220 | B2 | 9/2008 | White, III | |
| 7,547,073 | B2 | 6/2009 | White, III | |
| 7,806,474 | B2 * | 10/2010 | Wahl | A47C 13/005 297/248 |
| 7,963,612 | B2 | 6/2011 | Nelson | |
| 8,783,778 | B2 | 7/2014 | Nelson | |
| 9,277,813 | B2 | 3/2016 | Nelson | |
| 9,277,826 | B2 | 3/2016 | Nelson | |

(Continued)

FOREIGN PATENT DOCUMENTS

| | | | |
|---|---|---|---|
| CN | 205876899 | * | 1/2017 |
| WO | WO 2023/024606 A1 | | 3/2023 |
| WO | WO 2023/141742 A1 | | 8/2023 |

*Primary Examiner* — Mark R Wendell
(74) *Attorney, Agent, or Firm* — Nixon Peabody LLP

(57) ABSTRACT

An item of furniture includes a first module and a second module. The first module includes a frame assembly, a recliner mechanism mounted within the frame assembly of the first module, a footrest assembly coupled to the recliner mechanism, and a backrest configured to be coupled to the recliner mechanism. The item of furniture further includes a first foot configured to be mounted on the first module and a second foot configured to be mounted on the second module. The item of furniture also includes a first clip configured to couple of the first foot to the second foot when the first module with the first foot mounted thereon abuts the second module with the second foot mounted thereon to thereby couple the first module and the second module.

18 Claims, 13 Drawing Sheets

(56) References Cited

U.S. PATENT DOCUMENTS

| | | | | |
|---|---|---|---|---|
| 10,123,621 | B2 * | 11/2018 | Nelson | A47C 1/0347 |
| 10,143,307 | B2 | 12/2018 | Nelson | |
| 10,154,733 | B2 | 12/2018 | Nelson | |
| 10,806,261 | B2 | 10/2020 | Nelson | |
| 11,253,073 | B2 | 2/2022 | Nelson | |
| 2004/0095000 | A1 | 5/2004 | Durling | |
| 2011/0298340 | A1 * | 12/2011 | Nelson | A47C 3/029 312/107 |
| 2014/0062145 | A1 | 3/2014 | Iacovoni | |
| 2018/0000244 | A1 | 1/2018 | Nelson | |
| 2021/0195049 | A1 | 6/2021 | Ikawa | |
| 2021/0196049 | A1 * | 7/2021 | McCreary | A47C 17/04 |
| 2023/0066786 | A1 | 3/2023 | Zhao | |

* cited by examiner

FURNITURE ASSEMBLY WITH RECLINER MODULE

FIELD OF THE DISCLOSURE

The present disclosure relates to a furniture assembly that includes a recliner module and one or more transverse modules, one or more base modules, one or more additional recliner modules or some combination thereof coupled via a furniture connector.

BACKGROUND

A considerable number of conventional items of furniture are available in the furniture marketplace, including for example, leather, fabric, wood, and other options. Construction and assembly of a conventional item of furniture is cost and labor intensive. Since overall design is a prime driver of sales, development, and production of furniture items, industrialized and standardized production and delivery thereof is limited and efficiency is extremely low. Even though there are some modular furniture designs, they are limited to the disassembly of the furniture itself, which has no practical significance. Moreover, the hardware connectors used in existing modular furniture suffer from deficiencies and low practicability such that modular furniture does not appear to a significant extent in the furniture marketplace.

For instance, one conventional "modular sofa" includes at least two matching sofa monomers having insertion holes. During construction of the furniture assembly, the sofa monomers are positioned adjacent and a connecting nail is driven into the insertion holes to connect the monomers together. Once the monomers are connected and the sofa assembled, the monomers are not disconnected easily. Additionally, it is necessary to set insertion holes on the sofa monomers. As a result, processing, delivery, and installation costs for such a conventional "modular sofa" are high. Accordingly, such a modular sofa is not conducive to commercial utility or consumers appeal.

SUMMARY

In one embodiment, an item of furniture comprises a first module, wherein the first module is a recliner module, a first foot configured to be mounted on the first module, a second module, a second foot configured to be mounted on the second module, and a first clip configured to couple of the first foot to the second foot when the first module with the first foot mounted thereon abuts the second module with the second foot mounted thereon to thereby couple the first module and the second module. In one embodiment, the recliner module comprises a frame assembly, a recliner mechanism mounted within the frame assembly of the first module, a footrest assembly coupled to the recliner mechanism, and a backrest configured to be coupled to the recliner mechanism.

In one embodiment, the first clip comprises an elongate portion, a first arc-shaped portion extending from a first end of the elongate portion of the first clip and curving toward a second end of the elongate portion of the first clip; and a third arc-shaped portion extending from the second end of the elongate portion of the first clip and curving toward the first end of elongate portion of the first clip.

In one embodiment, each of the first foot and the second foot comprises a support portion having a first end configured to contact a support surface when in an upright configuration and a clamping portion extending from a second end of the support portion, the clamping portion configured to hugged by clip, wherein a cross-section of the support portion is larger in size than a cross-section of the clamping portion.

In one embodiment, the first clip further comprises a second arc-shaped portion extending from a first extremity of the first arc-shaped portion and curving away from the elongate portion of the first clip and a fourth arc-shaped portion extending from a first extremity of the third arc-shaped portion and curving away from the elongate portion of the first clip.

In one embodiment, the item of furniture further comprises a third module, a third foot configured to be mounted on the third module, a fourth foot configured to be mounted on the first module, and a second clip configured to facilitate the coupling of the third foot to the fourth foot when the third module with the third foot mounted thereon abuts the first module with the fourth foot mounted thereon to couple the third module and the first module.

In one embodiment, the third module comprises a base module, a transverse module, or another recliner module. In one embodiment, the second module comprises a base module, a transverse module, or another recliner module.

In one embodiment, the second module is a transverse module that comprises a frame assembly that includes a lateral wall and the frame assembly of the first module includes a seating surface having a slot therein, In this embodiment, the item of furniture further comprises a connecting member configured to be mounted on the lateral wall of the transverse module and extend into the slot of the seating surface of the first module to couple the transverse module to the first module.

In one embodiment, the connecting member comprises a first elongate portion configured to be mounted on the lateral wall of the transverse module, a second elongate portion configured to be inserted into the slot of the seating surface of the base module, and a linking portion spacing the first elongate portion of the connecting member from the second elongate portion of the connecting member and extending therebetween.

In one embodiment, a length of the connecting member is greater than a length of the first elongate portion of the connecting member and a length of the second elongate portion of the connecting member.

In one embodiment, the backrest comprises a frame assembly having an aperture therein. In this embodiment, the item of furniture further comprises a headrest and a rotation mounting component comprising a first elongate member, wherein a first portion of the first elongate member of the rotation mounting component is mounted to the headrest, a rotation mechanism connected to a second portion of the first elongate member of the rotation mounting component, and a second elongate member, wherein a first portion of the second elongate member of the rotation mounting component is connected to the rotation mechanism, and wherein a second portion of the second elongate member of the rotation mounting component is configured for insertion into the aperture of the frame assembly of the backrest to thereby couple the headrest to the backrest.

In one embodiment, the rotation mechanism is configured to lock the first elongate member of the rotation mounting component in a plurality of positions relative to the second elongate member of the rotation mounting component.

In one embodiment, a method of forming a furniture assembly comprises providing a seating component of a first module, wherein the first module is a recliner module. The seating component comprises a frame assembly, a recliner mechanism mounted within the frame assembly of the first module, and a footrest assembly coupled to the recliner mechanism. The method further comprises providing a backrest component of the first module, providing a first foot, providing a second module, providing a second foot, providing a clip, coupling the backrest component to the reclining mechanism, mounting the first foot on the first module, mounting the second foot on the second module, positioning the first module abutting the second module, and coupling the first foot to the second foot via the clip to thereby couple the first module and the second module.

In one embodiment, the first clip comprises an elongate portion, a first arc-shaped portion extending from a first end of the elongate portion of the first clip and curving toward a second end of the elongate portion of the first clip, and a third arc-shaped portion extending from the second end of the elongate portion of the first clip and curving toward the first end of the elongate portion of the first clip.

In one embodiment, each of the first foot and the second foot comprises a support portion having a first end configured to contact a support surface when in an upright configuration and a clamping portion extending from a second end of the support portion, the clamping portion configured to hugged by clip, wherein a cross-section of the support portion is larger in size than a cross-section of the clamping portion.

In one embodiment, the method further comprises providing a third module, providing a third foot, providing a fourth foot, providing a second clip, mounting the third foot on the third module, mounting the fourth foot on the first module, positioning the third module abutting the first module, and coupling the third foot to the fourth foot via the second clip to thereby couple the third module and the first module.

In one embodiment, the second module comprises a base module, a transverse module, or another recliner module.

In one embodiment, the backrest component comprises a frame assembly having an aperture therein. In one embodiment, the method further comprises providing a headrest with a rotation mounting component mounted thereto. In embodiment, the rotation mounting component comprises a first elongate member, wherein a first portion of the first elongate member of the rotation mounting component is mounted to the headrest, a rotation mechanism connected to a second portion of the first elongate member of the rotation mounting component, and a second elongate member, wherein a first portion of the second elongate member of the rotation mounting component is connected to the rotation mechanism, and wherein a second portion of the second elongate member of the rotation mounting component is configured for insertion into the aperture of the frame assembly of the backrest component. In one embodiment, the method further comprises inserting the second elongate member of the rotation mounting component into the aperture of the frame assembly of the backrest component to thereby couple the headrest to the backrest.

In one embodiment, the method the rotation mechanism is configured to lock the first elongate member of the rotation mounting component in one of a plurality of positions relative to the second elongate member of the rotation mounting component.

In one embodiment, the frame assembly of the first module includes a seating surface having a slot therein. In one embodiment, the second module is a transverse module that comprises a frame assembly and a connecting member mounted on a lateral wall of the frame assembly of the transverse module. In one embodiment, the connecting member is configured to extend into the slot of the seating surface of the first module. In one embodiment, the method further comprises lifting the second module off a support surface on which the second module rests, positioning the connecting member over the slot in the seating surface of the frame assembly of the first module, lowering the second module whereby the connecting member is inserted into the slot in the seating surface to thereby couple the transverse module to the first module.

In one embodiment, an apparatus comprises a first clip. The first clip comprises an elongate portion, a first arc-shaped portion, a second arc-shaped portion, a third arc-shaped portion, and fourth arc-shaped portions. The elongate portion of the first clip extends in a first direction to a first extremity of the elongate portion of the first clip and in a second direction to a second extremity of the elongate portion of the first clip. The first arc-shaped portion extends from the first extremity of the elongate portion of the first clip, curves toward the second direction, and extends to a first extremity of the first arc-shaped portion. The second arc-shaped portion extends from the first extremity of the first arc-shaped portion and curves toward the first direction. The third arc-shaped portion extends from the second extremity of the elongate portion of the first clip, curves toward the first direction, and extends to a first extremity of the third arc-shaped portion. The fourth arc-shaped portion extends from the first extremity of the third arc-shaped portion and curves toward the second direction.

In one embodiment, the first arc-shaped portion has a first at least partially circular shape, the second arc-shaped portion has a second at least partially circular shape, the third arc-shaped portion portion has a third at least partially circular shape, and the fourth arc-shaped portion portion has a fourth at least partially circular shape.

In one embodiment, the first at least partially circular shape of the first arc-shaped portion and the third at least partially circular shape of the third arc-shaped portion have a first diameter, and the second at least partially circular shape of the second arc-shaped portion and the fourth at least partially circular shape of the fourth arc-shaped portion have a second diameter.

In one embodiment, the first diameter is larger than the second diameter.

In one embodiment, the elongate portion of the first clip, the first arc-shaped portion, the second arc-shaped portion, the third arc-shaped portion, and the fourth arc-shaped comprise an elastic material.

In one embodiment, the second arc-shaped portion extends to a first extremity of the second arc-shaped portion and the fourth arc-shaped portion extends to a first extremity of the fourth arc-shaped portion.

In one embodiment, the clip further comprises a first extension that extends from the first extremity of the second arc-shaped portion and curves toward a third direction.

In one embodiment, the clip further comprises a second extension that extends from the first extremity of the fourth arc-shaped portion and curves toward a fourth direction.

In one embodiment, the first arc-shaped portion is configured to facilitate coupling to a first leg configured to be mounted on a first module and the third arc-shaped portion is configured to facilitate coupling of a second leg configured to be mounted on a second module, to thereby facilitate coupling of the first module to the second module when the first leg is mounted on the first module, the second leg is mounted on the second module, and the first module abuts the second module.

In one embodiment, the apparatus further comprises a first leg configured to be mounted on a first module and a second leg configured to be mounted on a second module, wherein the first leg and the second leg are configured to be coupled via the first clip.

In one embodiment, each of the first leg and the second leg comprises a first portion, wherein a cross-section of the first portion is at least partially circular-shaped with a first diameter.

In one embodiment, the first leg further comprises a second portion, wherein a cross-section of the second portion is at least partially circular-shaped and has a second diameter, wherein the second diameter is larger than the first diameter.

In one embodiment, the first leg further comprises a second portion, wherein a cross-section of the second portion of the first leg is non-circular-shaped.

In one embodiment, the apparatus further comprises the first module, wherein the first module is configured to have the first leg mounted thereon; and the second module, wherein the second module is configured to have the second leg mounted thereon.

In one embodiment, the first module comprises a first base module or a first transverse module, and wherein the second module comprises a second base module or a second transverse module.

In one embodiment, the apparatus further comprises: a third module, a third leg and a second clip. The third module comprises a third base module or a third transverse module. The third leg is configured to be mounted on the third module. The second clip is configured to couple the third leg to the second leg when the third leg is mounted on the third module, the second leg is mounted on the second module, and the third module abuts the second module.

In one embodiment, an item of furniture comprises a first module, a first foot configured to be mounted on the first module, a second module, a second foot configured to be mounted on the second module, and a first clip configured to facilitate coupling of the first foot to the second foot when the first module with the first foot mounted thereon abuts the second module with the second foot mounted thereon.

In one embodiment, the item of furniture further comprises a third module, a third foot configured to be mounted on the third module, and a second clip configured to facilitate the coupling of the third foot to the second foot when the third module with the third foot mounted thereon abuts the second module with the second foot mounted thereon.

In one embodiment, the first clip comprises an elongate portion, a first arc-shaped portion extending from a first end of the elongate portion of the first clip and curving toward a second end of the elongate portion of the first clip, and a third arc-shaped portion extending from the second end of the elongate portion of the first clip and curving toward the first end of the elongate portion of the first clip.

In one embodiment, the first clip comprises an elastic material.

In one embodiment, each of the first foot and the second foot comprises a support portion configured to contact a support surface when in an upright configuration, and a clamping portion configured to hugged by one of the first arc-shaped portion or the third arc-shaped portion.

In one embodiment, a cross-section of the support portion is larger in size than a cross-section of the clamping portion.

In one embodiment, the first clip further comprises a second arc-shaped portion extending from a first extremity of the first arc-shaped portion and curving away from the elongate portion of the first clip, and a fourth arc-shaped portion extending from a first extremity of the third arc-shaped portion and curving away from the elongate portion of the first clip.

Other embodiments of the item of furniture may include one or more of the features disclosed above with respect to the apparatus, first clip, and second clip.

In one embodiment, a method for forming a furniture assembly comprises providing a first module, a first foot, a second module, a second foot, and a clip. The method further comprises mounting the first foot on the first module and the second foot on the second module. The method further comprises positioning the first module abutting the second module and coupling the first foot to the second foot via the clip to thereby connect the first module and the second module. Other embodiments of the method forming a furniture assembly may include one or more of the features disclosed above with respect to the apparatus and item of furniture embodiments.

BRIEF DESCRIPTION OF THE DRAWINGS

The teaching of the present disclosure can be readily understood by considering the following detailed description in conjunction with the accompanying drawings, in which.

To facilitate understanding, identical reference numerals have been used, where possible, to designate elements that are common to the figures. It is noted that the figures depict only example embodiments of the disclosed headrest and therefore are not to be considered limiting.

DETAILED DESCRIPTION

Figure 1:
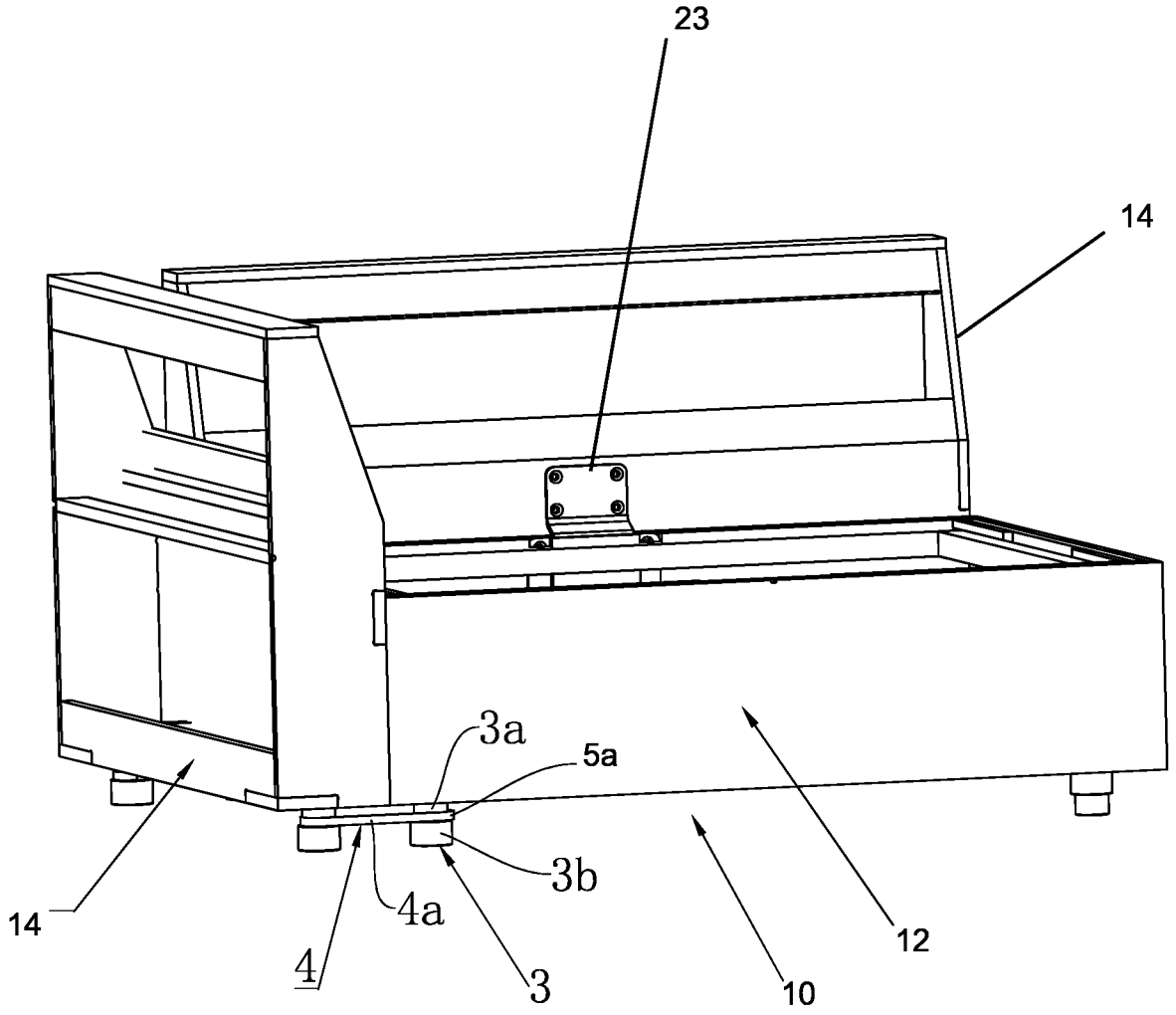
FIG. 1 is a three-dimensional schematic diagram illustrating an embodiment of a furniture assembly in which a base furniture module is coupled to transverse furniture modules to form a chair.

The present disclosure broadly discloses a furniture connector for connecting modules of an item of furniture and a furniture item formed using a furniture connector. As discussed above, a considerable number of conventional items of furniture having a variety of options are available in the furniture marketplace. However, construction and assembly of a conventional item of furniture is labor-intensive. Overall design is a prime driver of sales, development, and production of furniture items, resulting in limited applicability and extremely low efficiency in industrialized and standardized production and delivery of furniture items. Additionally, hardware connectors used in the limited number of existing modular furniture items suffer from deficiencies and low practicability such as a requirement for the creation of insertion holes and an inability to be connected easily. Moreover, conventional modular furniture items are limited as to the disassembly of the furniture itself and have little practical commercial significance for the consumer. As a result, modular furniture does not appear to any significant extent in the commercial marketplace.

One or more embodiments disclosed herein provide a clip for assembling an item of furniture that has a structure that is convenient to create and utilize. In addition, one or more of the disclosed clip embodiments enable ease of operation and the assembly, disassembly, and transport of furniture items having a wide range of applications.

In one embodiment, an item of furniture comprises a first clip. The first clip comprises an elongate portion that extends in a first direction to a first extremity of the elongate portion of the first clip and in a second direction to a second extremity of the elongate portion of the first clip. The first clip further comprises a first arc-shaped portion that extends from the first extremity of the elongate portion of the first clip, curves toward the second direction, and extends to a first extremity of the first arc-shaped portion. The first clip further comprises a second arc-shaped portion that extends from the first extremity of the first arc-shaped portion and curves toward the first direction. The first clip further comprises a third arc-shaped portion that extends from the second extremity of the elongate portion of the first clip, curves toward the first direction, and extends to a first extremity of the third arc-shaped portion. The first clip further comprises a fourth arc-shaped portion that extends from the first extremity of the third arc-shaped portion and curves toward the second direction.

The first, second, third, and fourth arc-shaped portions may each be at least partially circular-shaped. The at least partially circular-shaped portions of first arc-shaped portion and the third arc-portion may have a first diameter, and the at least partially circular-shaped portion of the second arc-shaped portion and the fourth arc-shaped portion may have a second diameter. In at least one embodiment, the first diameter is larger than the second diameter.

The elongate portion of the first clip and the first, second, third, and fourth arc-shaped portions may comprise an elastic material. The clip may also comprise a first extension that extends from a first extremity of the second arc-shaped portion and curves toward a third direction. The clip also may comprise a second extension that extends from the first extremity of the fourth arc-shaped portion and curves toward a fourth direction.

Thus, one embodiment of an apparatus comprises a clip, a first leg configured to be mounted on a first module, and a second leg configured to be mounted on a second module, wherein the first leg and the second leg are configured to be coupled via the clip. Each of the first leg and the second leg may include a first portion that has a cross-section that is at least partially circular-shaped with a first diameter. The first leg may also include a second portion that has a cross-section that is at least partially circular-shaped and has a second diameter, wherein the second diameter is larger than the first diameter. In another embodiment, the first leg also may include a second portion that has a cross-section that is is non-circular-shaped.

The first arc-shaped portion facilitates coupling to a first leg configured to be mounted on a first module and the third arc-shaped portion is configured to facilitate coupling of a second leg configured to be mounted on a second module, to thereby facilitate coupling of the first module to the second module when the first leg is mounted on the first module, the second leg is mounted on the second module, and the first module abuts the second module. In one embodiment, the first and second legs are connected via an elastic clip so that the first furniture module and the second furniture module are coupled together. For that purpose, the two ends of the elastic clip are respectively provided with elastic arc-shaped first and third portions (e.g., hugging portions), and the legs are correspondingly provided with a clamping portion. When deployed, an arc-shaped hugging portion is snap-fit, clamped and tightly held in the clamping portion of a leg.

Connection of furniture modules and assembly/disassembly of a furniture item using a clip is simple. For example, the hugging portions of an elastic clip may be retracted relative to the clamping portion of the legs, and the elastic arc-shaped first and third portions respectively snapped into the corresponding clamping portions of the first and second legs, thereby providing a stable connection. In one embodiment, the clamping portion of a leg is cylindrical, and the shape of the arc-shaped hugging portion of the clip is semicircular. In particular, the contour size of the arc-shaped hugging portion is consistent with the contour size of the clamping portion. Additionally, the clip may be connected to the clamping portion, which may be recessed from the leg proper and positioned thereon, so as to be hidden from view of a user of the furniture item and provide an aesthetic appearance.

The elastic clip may be integrally formed with a metal material, and both ends of the elastic clip bent toward each other to form the arc-shaped hugging portions, which are joined via a connecting rod of the clip. Processing and forming the clip is simple, saving production costs. The metal material used has high structural strength and is easy to process. In one embodiment, the length of the connecting rod is configured to be equal to the distance between a foot mounted on each of two adjacent furniture modules. Therefore, the arc-shaped embracing portions at both ends of an elastic clip can easily be hooked and fastened on the clamping portion of a respective foot. In one embodiment, the elastic clip is made of a metal strip plate and the arc-shaped foot-embracing portion of the clip has sufficient structural strength to enable elastic deformation and reset when the clip is clamped to feet.

In one embodiment, an extremity of the arc-shaped hugging portions is provided with a bending portion which is folded outwards. The bending portions provide an arc-shaped contact surface for the clamping portion of a foot and serve to avoid damaging the surfaces of the foot or scratching a user while coupling/uncoupling the furniture modules via the clip. In one embodiment, a foot includes a support portion that contacts a support surface, e.g., the floor, such that the user may appropriately sit on the furniture item.

In one embodiment, the support portion and the clamping portion of a foot are cylindrical, and the diameter of the support portion is larger than the diameter of the clamping portion; as such, the support portion is able to prevent the arc-shaped hugging portion, and thus the clip, from being detached downward from the clamping portion. Use of the clip disclosed herein for making the connection between the first furniture module and the second furniture module is convenient and fast for a user to accomplish by himself/herself and the modularity of the furniture modules permits separate packaging and simplified transportation with resultant work and cost savings as compared to conventional furniture.

The apparatus also may include the first module configured to have the first leg mounted thereon and the second module configured to have the second leg mounted thereon. The first module may be a first base module or a first transverse module, and the second module may be a second base module or a second transverse module. In one embodiment, the item of furniture (also referred to as a "furniture assembly" and "furniture item" herein) comprises a base module and a transverse module. The base and the transverse member are joined together so as to form the furniture assembly. The base serves as a support surface on which a user can sit, and the transverse member acts as a resting surface for a user's back or arm. The base may be configured such that the transverse member can be positioned adjacent in a variety of positions and joined thereto to form different types of furniture assemblies. For example, a base and a transverse member can be joined together to form a chair having a backrest. For example, base/s (of one or more sizes) and one or more transverse members (of one or more sizes) can be joined together to form a single-arm chair, a chaise lounge, a double-armed chair, a love seat, a sofa, a couch, a sectional, etc. For example, transverse member/s can be positioned adjacent or on the base/s in a variety of positions and joined together thereto to form furniture assemblies, such as a twister, a playpen or a bed. Alternatively, one or more bases may be joined together and one or more transverse members may be joined to the one or more bases so as to form the items of furniture noted above and additional alternative furniture items. When forming a furniture item from a first furniture module and a second furniture module, the shape and size of the modules may be the same or different. The specifications of the first furniture module and the second furniture module do not need to be consistent, and furniture modules of different sizes can be used to combine together Furthermore, base and transverse module/s may be proportionately sized by the manufacturer in order that furniture assemblies may be formed for different sized individuals. In other words, the base and transverse module/s can be utilized to form a variety of sizes of furniture. For example, the bases and transverse members can be proportionately sized to form furniture assemblies for children. Likewise, the bases and transverse members can be proportionately sized to form furniture assemblies for adults, or even big and tall sized adults.

In addition, one or more bases having a substantially similar configuration can be employed with one or more transverse members having a substantially similar configuration. The standardized configuration of bases and transverse members enables a user to form a variety of different types and configurations of furniture assemblies. Additionally, this also makes manufacturing convenient because a manufacturer can produce and offer a series of furniture items and/or a series of bases that have a substantially similar configuration and a series of transverse members that have a substantially similar configuration. The manufacturer may join (or allow the end user to purchase, arrange, and join) bases and transverse members into a variety of configurations to form different types of furniture. In another alternative embodiment, a plurality of shapes of transverse members and bases may be employed in order to achieve unique and useful furniture configurations. Accordingly, in one embodiment, the apparatus further comprises: a third module, a third leg and a second clip. The third module comprises a third base module or a third transverse module. The third leg is configured to be mounted on the third module. The second clip is configured to couple the third leg to the second leg when the third leg is mounted on the third module, the second leg is mounted on the second module, and the third module abuts the second module.

One embodiment of an item of furniture includes a first module, a first foot configured to be mounted on the first module, a second module, a second foot configured to be mounted on the second module, and a first clip configured to facilitate coupling of the first foot to the second foot when the first module with the first foot mounted thereon abuts the second module with the second foot mounted thereon. The first clip may include an elongate portion, a first arc-shaped portion extending from a first end of the elongate portion of the first clip and curving toward a second end of the elongate portion of the first clip, and a third arc-shaped portion extending from the second end of the elongate portion of the first clip and curving toward the first end of the elongate portion of the first clip. The first clip may be formed from an elastic material. Each foot may include a support portion configured to contact a support surface when in an upright configuration, and a clamping portion configured to hugged by one of the first arc-shaped portion or the third arc-shaped portion. In one embodiment, a cross-section of the support portion may be larger in size than a cross-section of the clamping portion. In one embodiment, the cross section of the clamping portion is cylindrical.

The first clip further also may include a second arc-shaped portion extending from a first extremity of the first arc-shaped portion and curving away from the elongate portion of the first clip, and a fourth arc-shaped portion extending from a first extremity of the third arc-shaped portion and curving away from the elongate portion of the first clip. The second and fourth arc-shaped portions provide a surface that prevent the clip from damaging the legs to which the clip is attached or the user's hands when installing the clip.

A furniture assembly may be formed by providing a first module, a first foot, a second module, a second foot, and a clip; mounting the first foot on the first module and the second foot on the second module; positioning the first module abutting the second module; and coupling the first foot to the second foot via the clip. Such a furniture assembly provides many benefits to both the consumer and retailer. For example, a consumer may receive a modular furniture item in a remote location where previously other furniture items could not be moved due to their bulkiness and/or size. The modular furniture item disclosed herein is easily disassembled, thus enabling a consumer to locate the base/s and/or transverse module/s in an otherwise inaccessible location and then assemble them via clips to form a furniture assembly. Further, the manufacturer and/or retailer may stock a limited number of configurations of the base and the transverse member, for example one base and one transverse member, which is advantageous for shipping and storing the furniture item. For instance, the manufacturer and/or retailer is only required to store two primary pieces, which allows bases or transverse members having the same respective configuration to be conveniently packaged and stacked for storage and freight transport and also simplifies customer ordering of furniture items. In addition, the transverse member and the base may include removable outer liners to permit the consumer to easily launder the furniture assembly. Further, a removable outer liner allows a consumer to interchange liners of different shades and styles to create a unique and customized furniture assembly. Thus, the furniture assembly and clip described herein provide versatility, modularity, interchangeability, cost efficiency and convenience.

To aid in understanding the present disclosure, reference is first made to FIG. 1 which is a three-dimensional schematic diagram illustrating an embodiment of a furniture assembly in which a base furniture module is coupled to transverse furniture modules to form a chair. With reference to FIG. 1, furniture assembly 10 comprises a first base module 12 and at least one second transverse module 14 detachably coupled to the first module 12 via a clip 4 (see FIG. 3: clip 4 comprising 4, 5*a-b*, 6*a-b*, and 7*a-b*). Base module 12 and transverse module 14 are configured to be detachably coupled to each other in a variety of configurations so as to form a variety of unique and custom furniture assemblies. Further, base module and transverse module are sized and configured to enable the convenient formation of a variety of different types of furniture assemblies, the convenient formation of a variety of different configurations of furniture assemblies, and the convenient formation of proportionately sized furniture assemblies for different sized individuals, such as children or adults. In particular, the illustrated embodiment shows the clip 4 coupling leg 3 (see FIG. 3: leg 3 comprising 3*a* and 3*b*) mounted on base module 12 to a leg mounted on transverse module 14 to thereby couple the base module to the transverse module.

Base module 12 is configured to provide the consumer with a comfortable sitting surface and may include a fabric covering and removable cushion (not shown) so as to provide a useful and comfortable sitting area for the consumer. Transverse module 14 is configured to provide lateral support to a consumer seated on the sitting surface of the base module when the base module 12 is coupled thereto. A transverse module also may include a fabric covering and removable cushion (not shown) so as to provide a useful and comfortable resting surface for the consumer. A foot 3 is connected to the underside of the furniture modules 12, 14 that are used to form the furniture item 10. A foot can be connected to a furniture module in a variety of ways. For example, a foot may include attached screw which is screwed into a hole in a furniture module. In this embodiment, a foot can be easily coupled to and/or removed from furniture module so as to facilitate ease in packaging, shipping, storing, moving and/or replacing a foot. However, in another embodiment, feet are coupled to a furniture module in a more permanent fashion, such as a nail, an epoxy or glue, or any combination thereof. The feet facilitate the coupling of first furniture module 12 to a second furniture module 14 when used in conjunction with a clip 4. Feet 3 are further configured to support the weight of a consumer and to elevate furniture modules above the floor.

Figure 2:
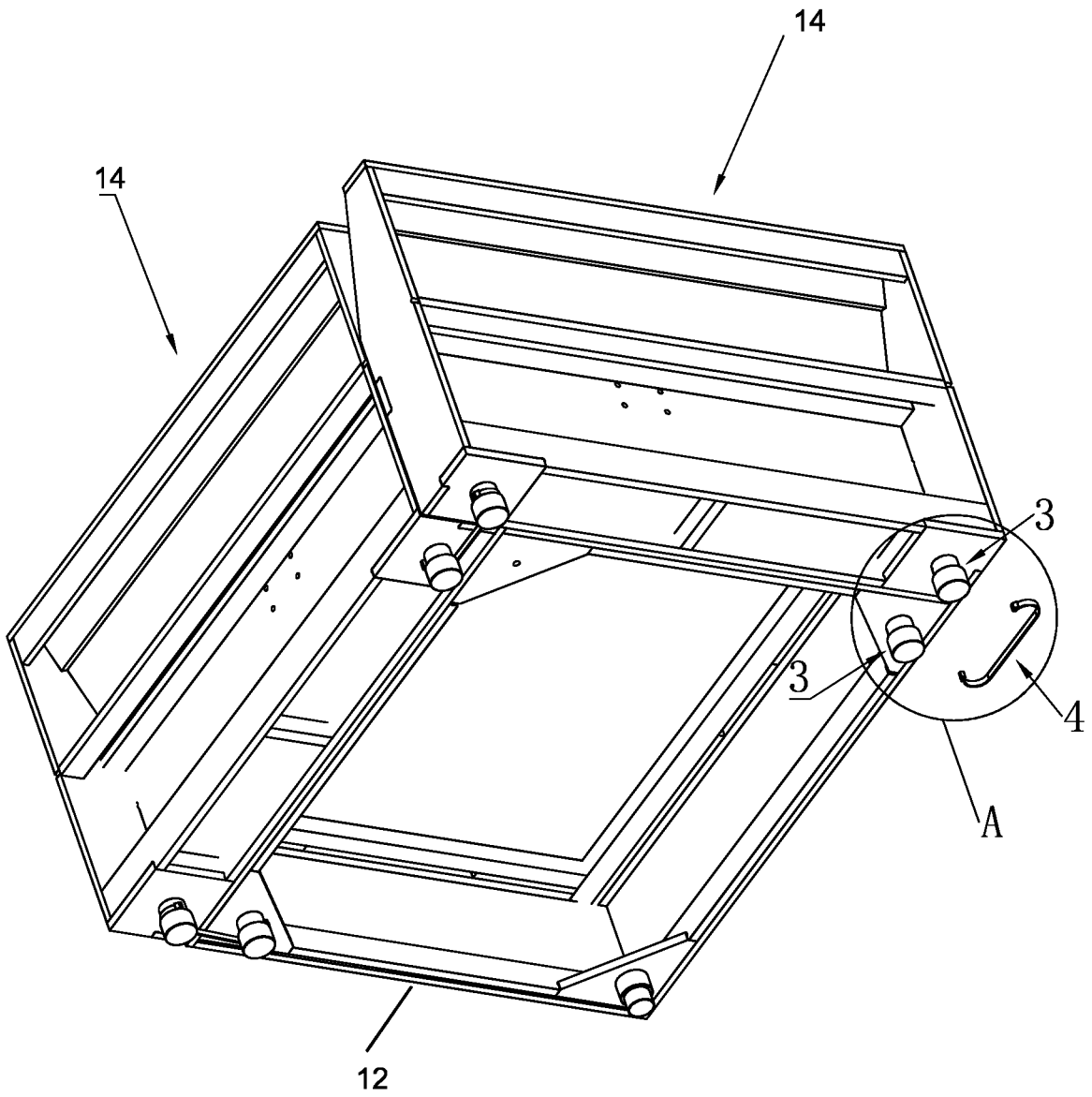
FIG. 2 is a three-dimensional schematic diagram illustrating a manner by which a base furniture module is coupled to transverse furniture module by a clip in order to assemble a chair.

FIG. 2 is a three-dimensional schematic diagram illustrating the manner by which a base furniture module is coupled to transverse furniture module by a clip in order to assemble a chair. Base module 12 includes a plurality of abutting surfaces that are configured to be positionable adjacent to and abut with an abutting surface of transverse member 14. Base module 12 is configured such that transverse member 14 can be positioned adjacent any abutting surface of the base for forming a variety of different furniture assemblies. When a first furniture module (e.g., 14) is positioned abutting a second furniture module (e.g. 12), the clip is used to couple feet 3 mounted on the furniture modules. For example, in the embodiment depicted in FIG. 1 and FIG. 2, a first base module 12, a first transverse module 14, and a second transverse module 14 are utilized to form a one-armed chair. A third transverse module 14 having a substantially similar configuration as the first and second transverse modules 14 can be added to the embodiment of FIG. 1 so as to form an arm chair having a first arm rest and a second arm rest, as illustrated in FIG. 4A. As used herein, the phrase substantially similar configuration can mean that the bases and/or transverse modules are respectively sized and configured so as to be interchangeable.

Optionally, a chaise lounge can be formed by adding a second base module 12 having a substantially similar configuration as the first base module 14 to the embodiment of FIG. 1, as illustrated in FIG. 4B. Alternatively, a couch can be formed by adding: a second base module 12 having a substantially similar configuration as the first base module 12 and third and fourth transverse modules 14 having a substantially similar configuration as the first and second transverse module 14, as illustrated in FIG. 5A and FIG. 5B. The couches formed utilizing two base modules 12 and four transverse modules 14 can be arranged so as to form a love seat, as illustrated by FIG. 5A, or a deep sofa, as illustrated by FIG. 5B. The love seat of FIG. 5A and the deep sofa of FIG. 5B employ the same base modules 12 and the same transverse modules 14, but are arranged differently. The ability to add together base module/s and/or transverse module/s enables a user to conveniently form a variety of different types of furniture.

Figure 3:
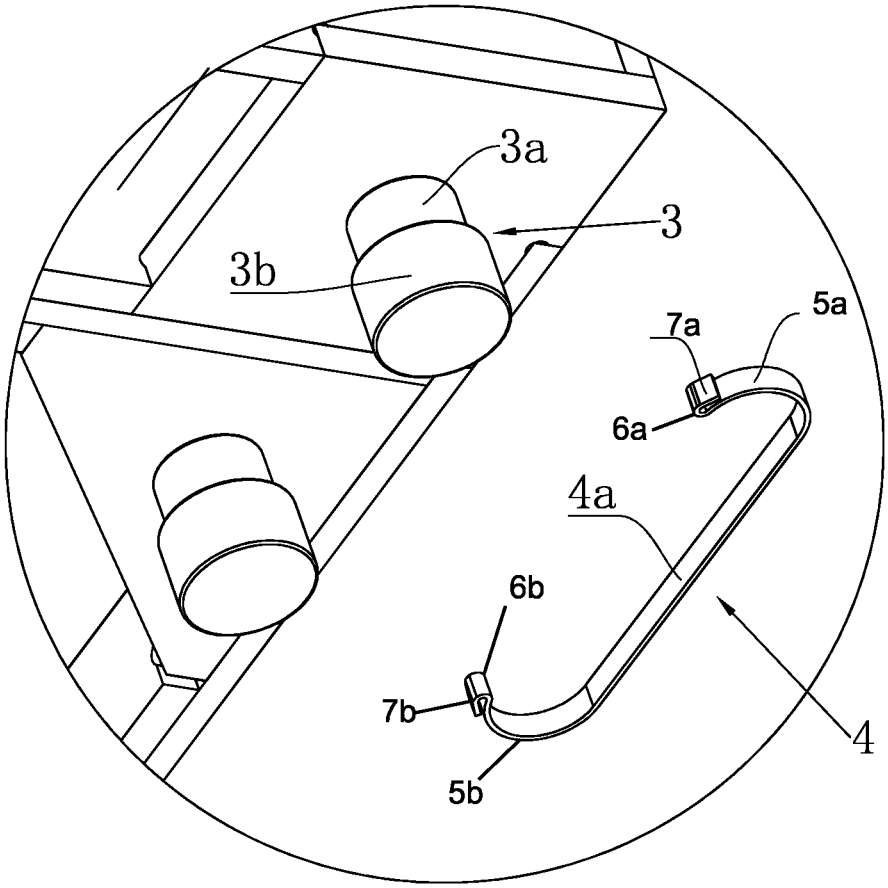
FIG. 3 is an exploded three-dimensional schematic diagram of section A in FIG. 2 illustrating a manner by which a leg mounted on a base furniture module is coupled to a leg mounted on a transverse furniture module by a clip in order to assemble a chair.

FIG. 3 is an exploded three-dimensional schematic diagram of section A in FIG. 2 illustrating the manner by which a leg mounted on a base furniture module is coupled to a leg mounted on a transverse furniture module by a clip in order to assemble a chair. In FIG. 3, the clip 4 comprises an elongate portion 4*a* that extends in a first direction to a first extremity of the elongate portion of the clip and in a second direction to a second extremity of the elongate portion of the clip. A first arc-shaped portion 5*a* extends from the first extremity of the elongate portion 4*a* of the clip, curves toward the second direction, and extends to a first extremity of the first arc-shaped portion. A second arc-shaped portion 6*a* extends from the first extremity of the first arc-shaped portion 5*a* and curves toward the first direction. A third arc-shaped portion 5*b* extends from the second extremity of the elongate portion 4*a* of the clip, curves toward the first direction, and extends to a first extremity of the third arc-shaped portion. A fourth arc-shaped portion 6*b* that extends from the first extremity of the third arc-shaped portion and curves toward the second direction.

The first, second, third, and fourth arc-shaped portions (5*a*, 6*a*, 5*b*, 6*b*) may each be at least partially circular-shaped. The at least partially circular-shaped portions of first arc-shaped portion and the third arc-portion may have a first diameter, and the at least partially circular-shaped portion of the second arc-shaped portion and the fourth arc-shaped portion may have a second diameter. In at least one embodiment, the first diameter is larger than the second diameter.

The clip may include an elastic material. The elongate portion of the clip and the first, second, third, and fourth arc-shaped portions may include an elastic material. In one embodiment, a first extension 7*a* extends from a first extremity of the second arc-shaped portion 6*a* and curves toward a third direction. The clip also may include a second extension 7*b* extending from the first extremity of the fourth arc-shaped portion 6*b* and curving toward a fourth direction.

In FIG. 3, the clip 4 is configured to couple a first leg 3*a* mounted on a first module and a second leg 3 mounted on a second module. Each of the first leg and the second leg may include a first portion 3*a* that has a cross-section that is at least partially circular-shaped with a first diameter. The first leg 3 may also include a second portion 3*b* that has a cross-section that is at least partially circular-shaped and has a second diameter. The second diameter may be larger than the first diameter. In another embodiment, the first leg 3 also may include a second portion 3*b* that has a cross-section that is non-circular-shaped.

The first arc-shaped portion 5*a* facilitates coupling to a first leg 3 configured to be mounted on a first module and the third arc-shaped portion 5*b* is configured to facilitate coupling of a second leg configured to be mounted on a second module, to thereby facilitate coupling of the first module to the second module when the first leg is mounted on the first module, the second leg is mounted on the second module, and the first module abuts the second module. In one embodiment, the first and second legs are connected via an elastic clip so that the first furniture module and the second furniture module are coupled together. For that purpose, the two ends of elongate portion 4*a* of the elastic clip 4 are respectively provided with elastic arc-shaped first and third portions 5*a*, 5*b* (e.g., hugging portions), and the legs are correspondingly provided with a first portion 3 (e.g., clamping portion) to which the elastic clip is attached. To couple legs, an arc-shaped hugging portion is snap-fit, clamped and tightly held in the clamping portion of a leg. To assemble/disassemble a furniture item, the hugging portions of an elastic clip may be retracted relative to the clamping portion of the legs, and the elastic arc-shaped first and third portions respectively snapped into the corresponding clamping portions of the first and second legs mounted on respective furniture modules, thereby providing a stable connection.

In one embodiment, the clamping portion 53*a* of a leg is cylindrical, and the shape of the arc-shaped hugging portion 5*a*, 5*b* of the clip 4 is semicircular. In particular, the contour and size of the arc-shaped hugging portion is consistent with the contour and size of the clamping portion. Additionally, the clip may be connected to the clamping portion, which may be recessed from the leg proper and positioned thereon, so as to be hidden from view of a user of the furniture item and provide an aesthetic appearance.

The elastic clip 4 may be integrally formed with a metal material, with both ends of the elastic clip bent toward each other to form the arc-shaped hugging portions 5*a*, joined via a connecting rod 4*a* of the clip. The metal material used has high structural strength and is easy to process. The length of the connecting rod may be configured to be equal to the distance between a foot mounted on each of two adjacent furniture modules. Therefore, the arc-shaped embracing portions at both ends of an elastic clip can easily be hooked and fastened on the clamping portion of a respective foot. The elastic clip may be made of a metal strip plate and the arc-shaped foot-embracing portion of the clip has sufficient structural strength to enable elastic deformation and reset when the clip is clamped to feet.

In one embodiment, an extremity of the arc-shaped hugging portions 5*a*, 5*b* is provided with a bending portion 6*a*, 6*b* which is folded outwards. The bending portions provide an arc-shaped contact surface for the clamping portion 3*a* of a foot 3 and serve to avoid damaging the surfaces of the foot or scratching the user while operating the clip to couple/uncouple furniture modules. In one embodiment, a foot includes a support portion 3*b* that contacts a support surface, e.g., the floor, such that the user may appropriately sit on the furniture item.

In one embodiment, the support portion 3*b* and the clamping portion 3*a* of a foot 3 are cylindrical, and the diameter of the support portion is larger than the diameter of the clamping portion. Accordingly, the support portion prevents the arc-shaped hugging portion, and thus the clip, from being detached downward from the clamping portion. Use of the clip disclosed herein for making the connection between the first furniture module and the second furniture module is convenient and fast for a user to accomplish by himself/herself and the modularity of the furniture modules permits separate packaging and simplified transportation with resultant work and cost savings as compared to conventional furniture.

Figure 4:
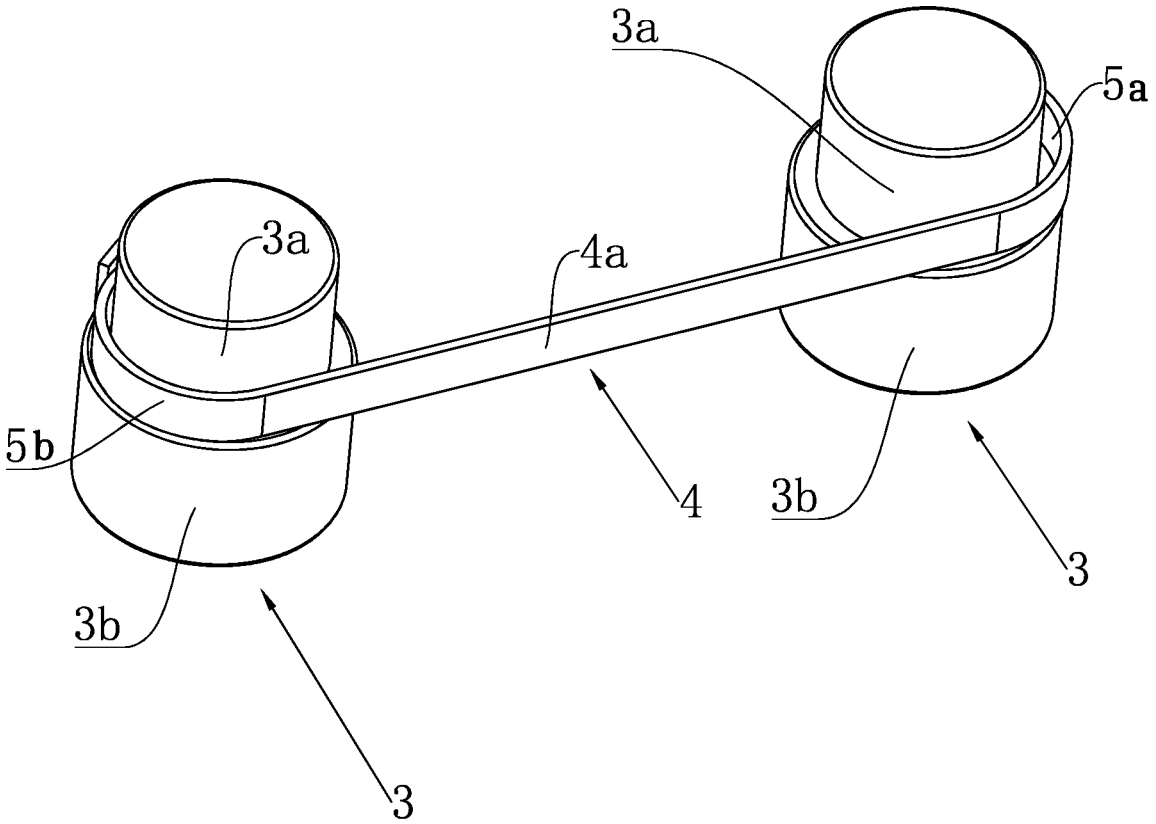
FIG. 4 is three-dimensional schematic diagram illustrating arc-shaped hugging portions at both ends of the clip respectively fastened on the clamping portion of a first leg and a second leg.

FIG. 4 is three-dimensional schematic diagram illustrating arc-shaped hugging portions 5*a*, 5*b* at both ends of the elongate portion 4*a* of the clip 4 respectively fastened on the clamping portion 3*a* of a first leg 3 and the clamping portion 3*a* of second leg 3.

Figure 5:
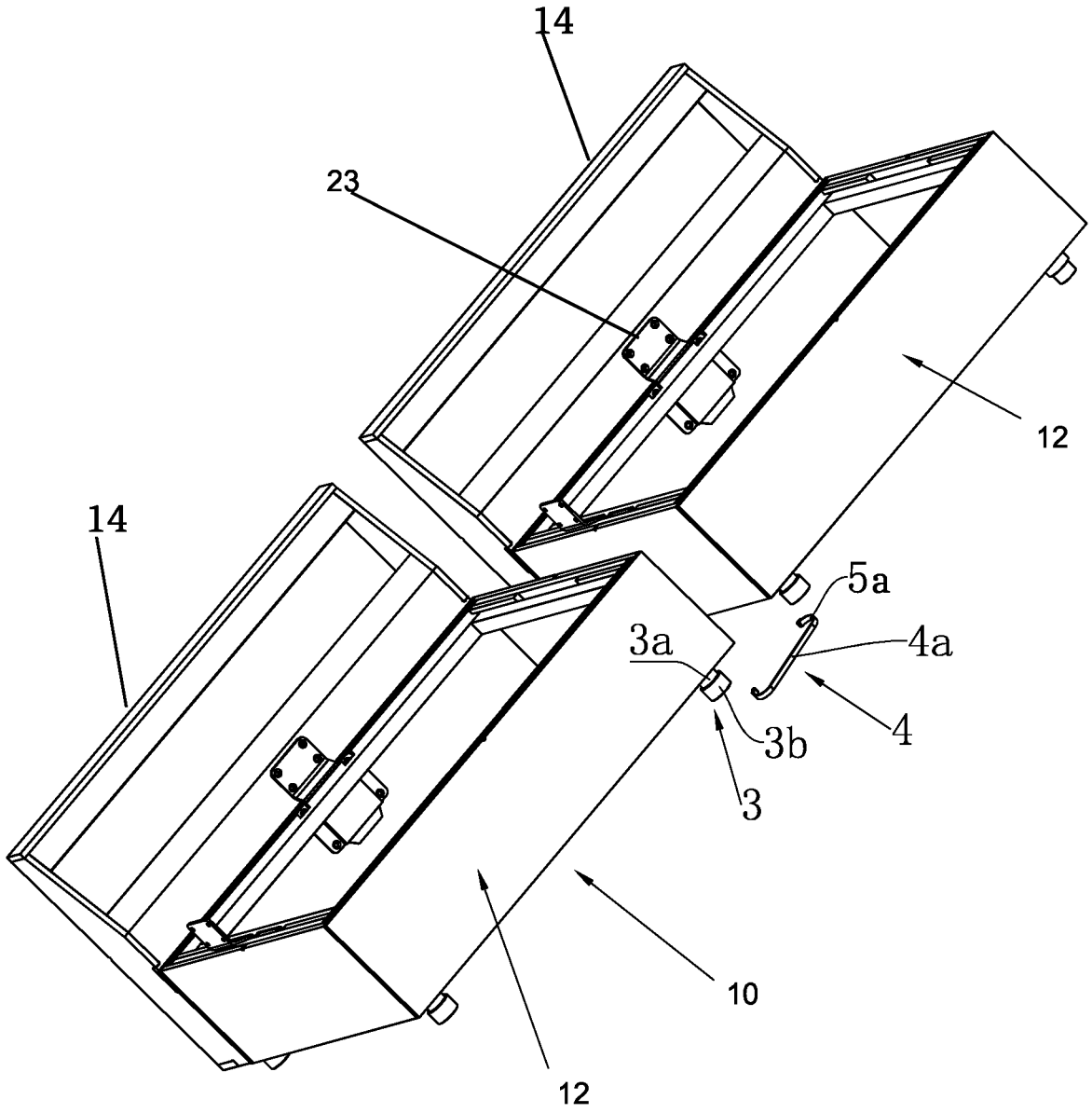
FIG. 5 is three-dimensional schematic diagram illustrating an embodiment of a furniture assembly formed using a plurality of the base furniture modules, a plurality of transverse furniture modules, a plurality of feet and a plurality of clips, each plurality having a respective same configuration.

FIG. 5 is three-dimensional schematic diagram illustrating an embodiment of a furniture assembly formed using a plurality of the base furniture modules, a plurality of transverse furniture modules, a plurality of feet and a plurality of clips, each plurality having a respective same configuration. In FIG. 5, a couch is formed by combining a first base module 12 and a second base module 12 having a substantially similar configuration and first transverse module 14 and second transverse modules 14 having a substantially similar configuration using a plurality of feet and clips.

Furniture modules may each include a selectively removable outer liner that is configured to be easily removed and reattached so as to provide easy laundering thereof. The outer liner may cover surfaces of the furniture modules that are covered by one or more pieces of foam which have sufficient resilience and appropriate properties so as to provide a comfortable surface for the user to touch or lean against. For example, removable outer liners made out of materials such as cotton, leather, micro-fiber, suede, or any other type of material that a consumer may wish to utilize may be detachably coupled through the use of a removable securing mechanism, such as a hook and pile mechanism, e.g. VELCRO, one or more zippers, male and female snap members, hook and latch type fasteners, or any other type of securing means that will facilitate the outer liners being selectively removable. In this manner, a consumer has the option to mix and match varying types, styles and configurations of removable outer liners so as to form a unique and customized furniture assembly according to their desire and tastes.

In the example furniture assembly of FIG. 5, a transverse furniture module 14 is additionally connected to a base furniture module 12 via a connecting member 23. Connecting member 23 comprises a first connecting section, an intermediate section and a second connecting section along its length direction. In one embodiment, the height of the transverse furniture module is higher than the height of the base furniture module, and the first connecting section is fixedly arranged on the side wall surface of the transverse furniture module at a position higher than the height of the base furniture module via screws in order to facilitate disassembly and assembly. The intermediate section on the connecting member 23 extends in a direction away from the side wall of the transverse module when the first connecting section 4 is fixed arranged thereto, and the second connecting section extends vertically downwards. Accordingly, the connecting member forms a Z-shaped structure as a whole. At the same time, a slot is provided at an edge of the upper surface of the base module (upper referring to the position relative to the base being in an upright configuration for the user to sit thereupon).

For connection of the base module and transverse module via the connecting member, it is only necessary to lift the transverse module and then put it down so that the second connecting section is inserted into the slot to complete the connection and fixation. For disconnection, it is only necessary to lift the transverse module and move it to the side to complete the disassembly between the transverse module and the base module. Both connection and disconnection are convenient and quick. In addition, the Z-shape of the connecting member enables the base and transverse furniture modules to abut each other without a gap therebetween, which is both aesthetically and functionally (e.g., space saving) pleasing.

In one embodiment, the base furniture module is provided with slots at each peripheral edge of the upper surface of the base module. In one embodiment, the base module includes four side plates (e.g, lateral walls), with two of the four side plates paired in pairs, the paired two side plates are arranged oppositely so as to form support frame. The inner wall of a side plate is provided with a bearing member, and a seat support is placed on the bearing member. A space is left between the side wall of the seat cushion and the adjacent side plate to form the aforementioned slot. However, one can readily understand that due to the long length of the slot, when the second connecting section of the connecting member is inserted into the slot, the transverse module may slide relative to the slot along the length of the slot.

Accordingly, in one embodiment, a limiting member is provided on the wall of the slot (i.e., on the inner wall of the side plate). The limiting member acts on the second connecting section to force the second connecting section and the side plate to remain relatively fixed when the second connecting section of the connecting member is inserted into the slot. In particular, both ends of the limiting member in this embodiment are bent forward to form a U-shaped member. At the same time, both ends of the U-shaped member are provided with connecting ears extending to the side. During installation, the transverse module is lifted first, and the second connecting section of the connecting member is aligned with an insertion hole formed between the limiting member and the wall of the slot. As the transverse module is put down, the second connecting section of the connecting member is inserted into the insertion hole and is be kept relatively fixed with the side plate, so that the transverse module is kept relatively fixed with respect to the base module. In addition, the outer liner of the base module include apertures that align with the slot or insertion hole and the outer liner of the transverse module includes an escape hole for the second connecting portion of the connecting member to pass through. A seat cushion may be placed on the base module and because the space between the side wall of the seat cushion and the adjacent side plate of the base module will form a slot, and there is no need to slot the seat cushion, allowing a standard cushion to be used for the furniture assembly disclose herein or for other furniture items.

Figure 6B:
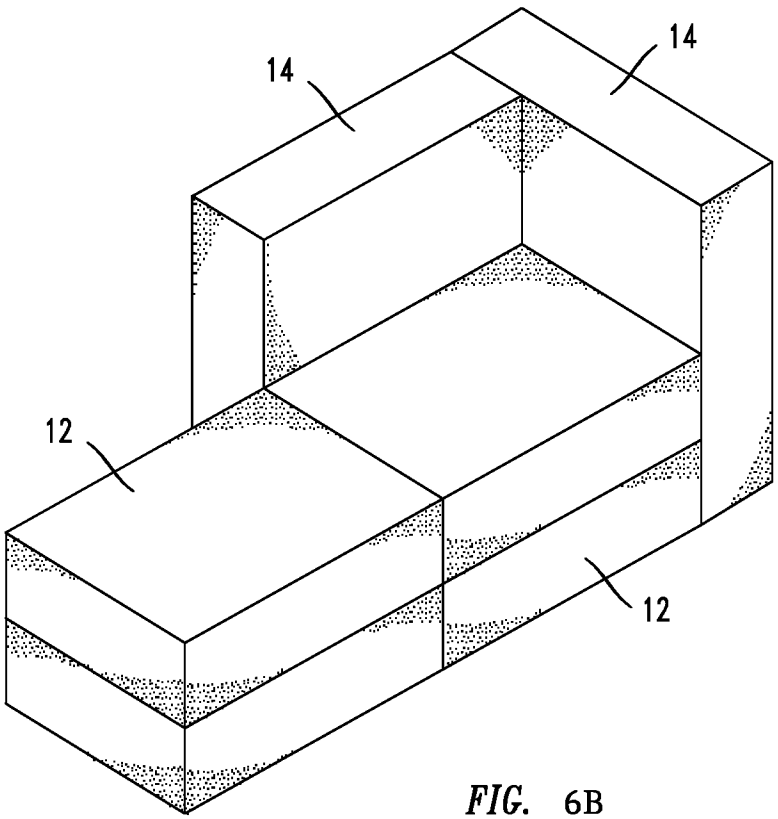
FIG. 6B illustrates a modular furniture assembly in the configuration of a chaise.
Figure 6A:
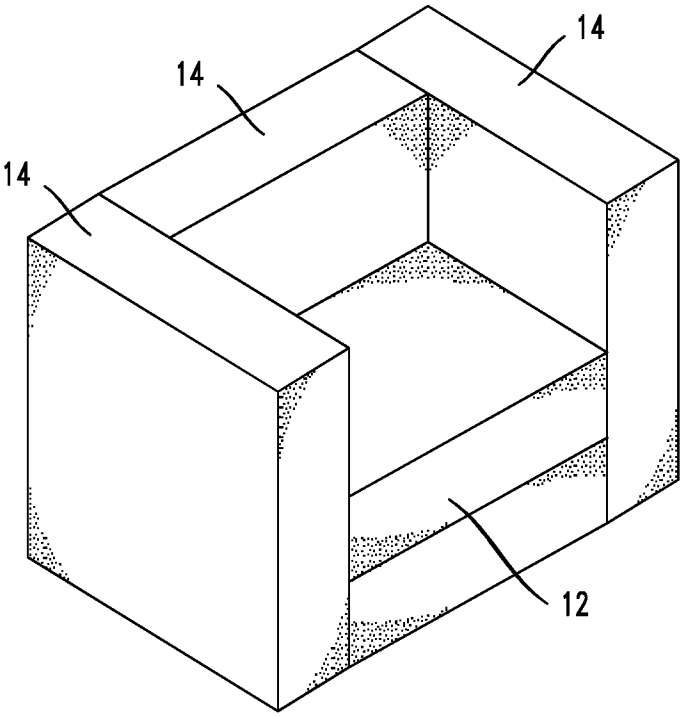
FIG. 6A illustrates a modular furniture assembly in the configuration of an arm chair.

FIG. 6A illustrates an embodiment of a furniture assembly in the form of a two-armed chair. As shown, a first base 12 and a first, second and third transverse member 14 are utilized to form the arm chair having a first arm rest and a second arm rest. The arm chair is formed by coupling or interconnecting the first base, the first transverse member, the second transverse member, and the third transverse member in the manner described with respect FIGS. 1-5.

FIG. 6B illustrates an embodiment of a furniture assembly in the form of a chaise lounge. As shown, a first base module 12, a second base module 12, a first transverse module 14, and second transverse module 14 are coupled via clips, as described herein, to form the chaise lounge having an arm rest.

Figure 7B:
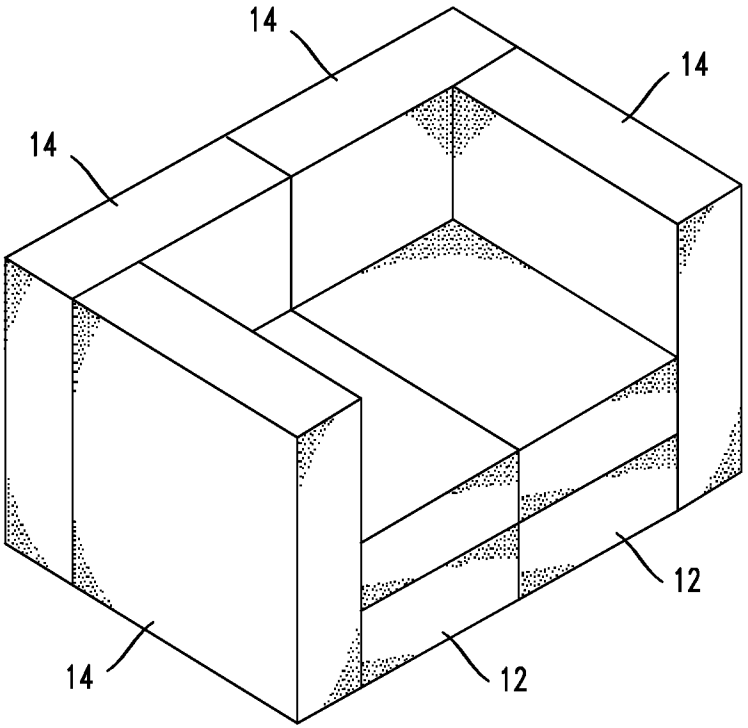
FIG. 7B illustrates a modular furniture assembly in the configuration of a deep sofa.
Figure 7A:
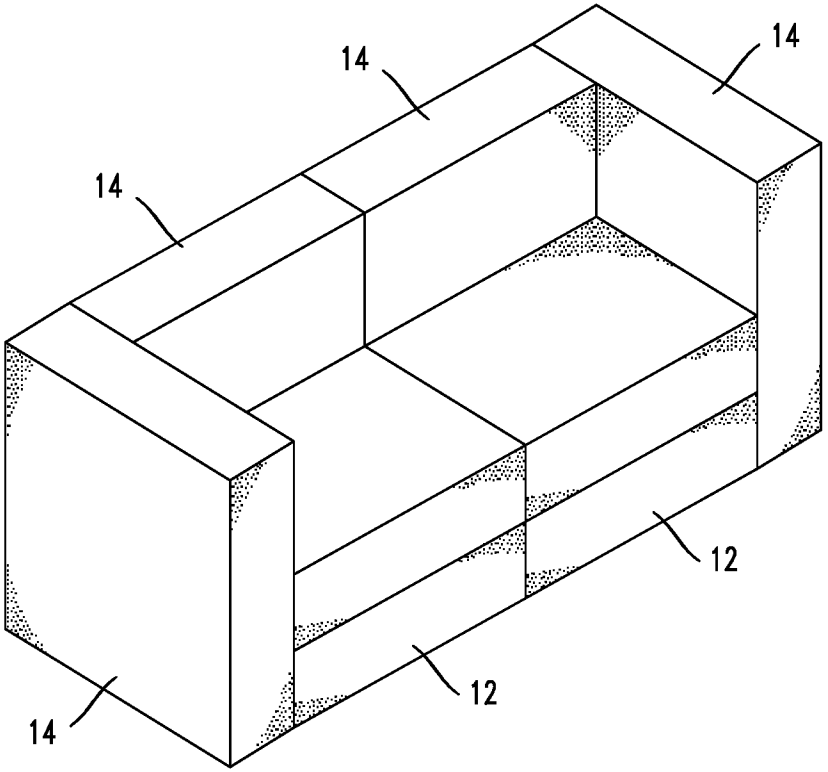
FIG. 7A illustrates a modular furniture assembly in the configuration of a love seat.

FIG. 7A illustrates an embodiment of a furniture assembly in the form of a love seat. As shown, two bases 12 and four transverse members 14 are utilized to form a love seat.

FIG. 7B illustrates an embodiment of a furniture assembly in the form of a deep sofa. As shown, two bases 12 and four transverse members 14 are utilized to form the deep sofa. The love seat of FIG. 7A and the deep sofa of FIG. 7B may employ the same bases 12 and the same transverse members 14, but arranged differently. The ability to combine base/s and/or transverse member/s enables a user to conveniently form a variety of different types of furniture items.

Figure 8:
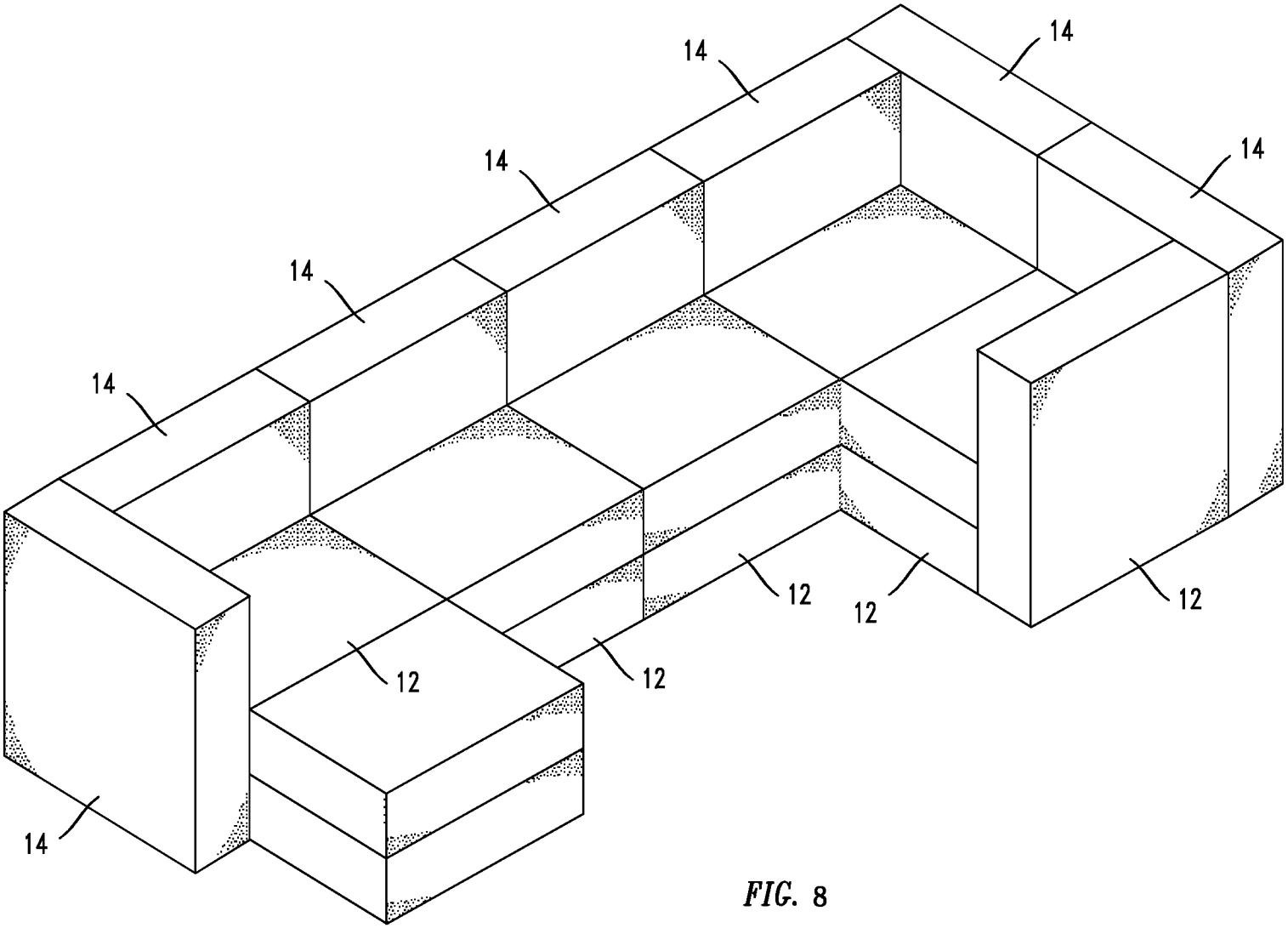
FIG. 8 illustrates a modular furniture assembly in the configuration of a sectional.
Figure 9A:
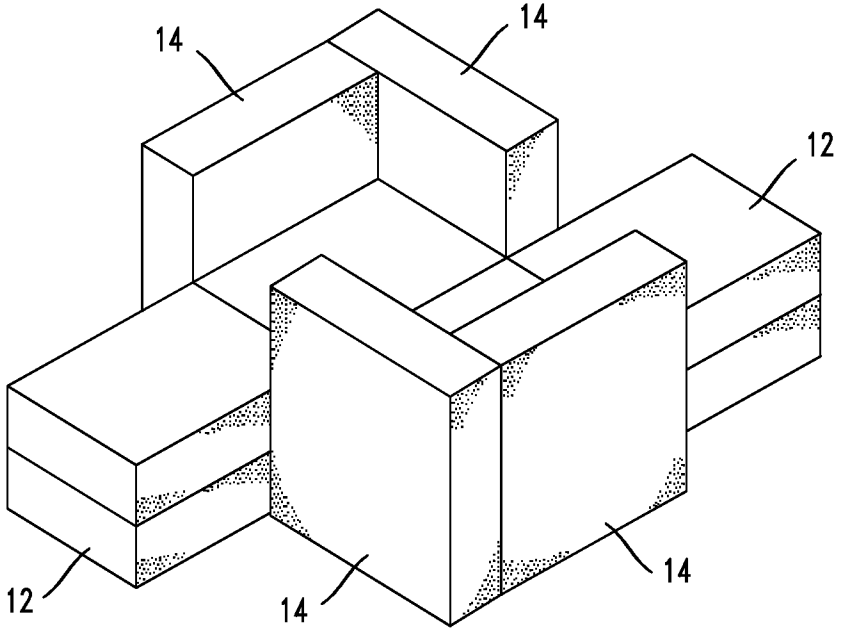
FIG. 9A illustrates a modular furniture assembly in the configuration of a twister.
Figure 9B:
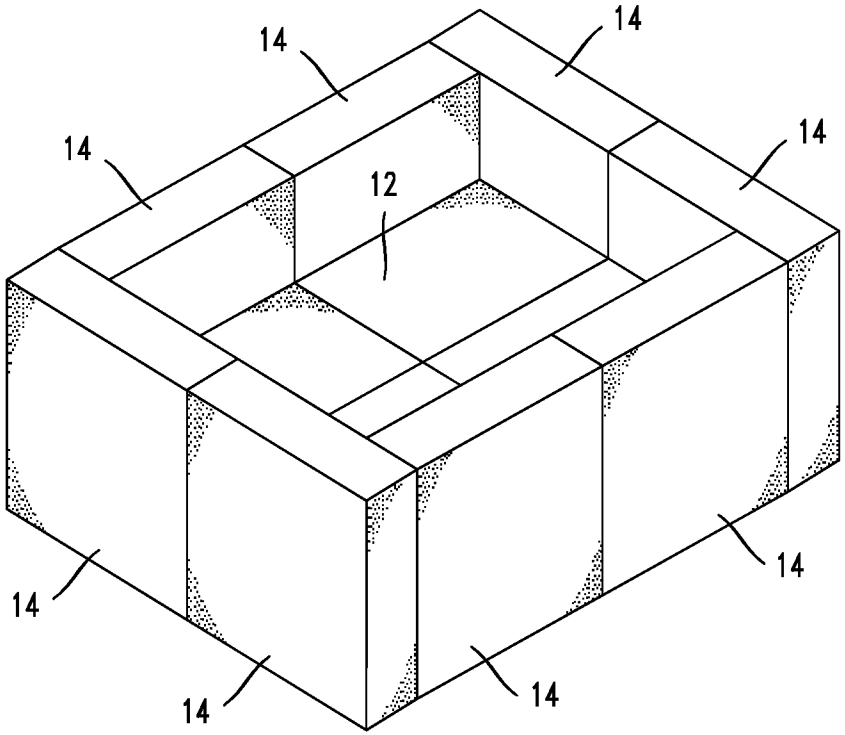
FIG. 9B illustrates a modular furniture assembly in the configuration of a playpen.
Figure 10:
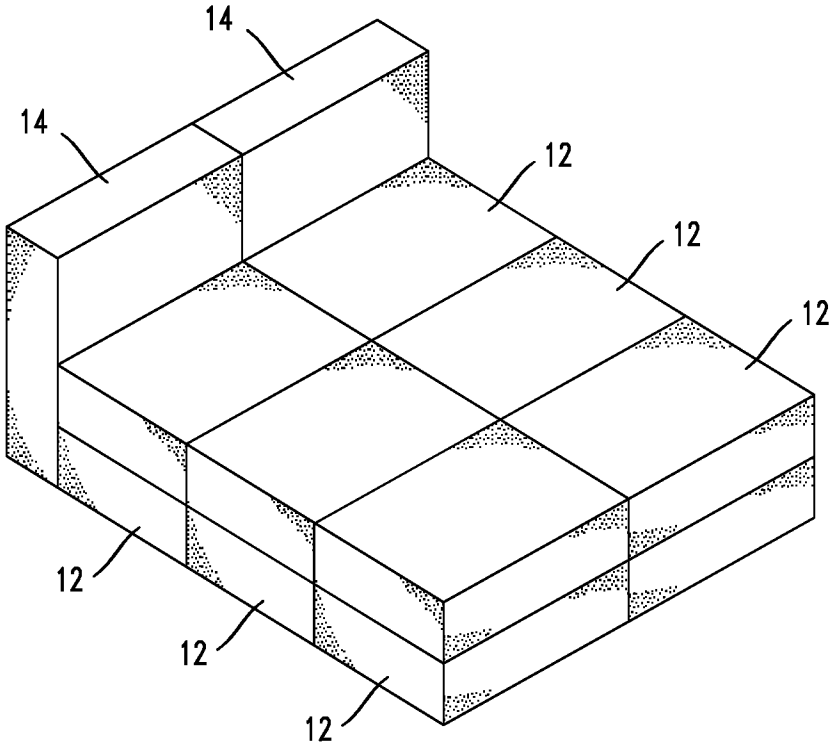
FIG. 10 illustrates a modular furniture assembly in the configuration of a bed.

As further shown in FIGS. 8, 9A, 9B and 10, a user may conveniently form a variety of different configurations of furniture assemblies. FIG. 8 illustrates a modular furniture assembly in the configuration of a sectional. FIG. 9A illustrates a modular furniture assembly in the configuration of a twister. FIG. 9B illustrates a modular furniture assembly in the configuration of a playpen. FIG. 10 illustrates a modular furniture assembly in the configuration of a bed.

Figure 11:
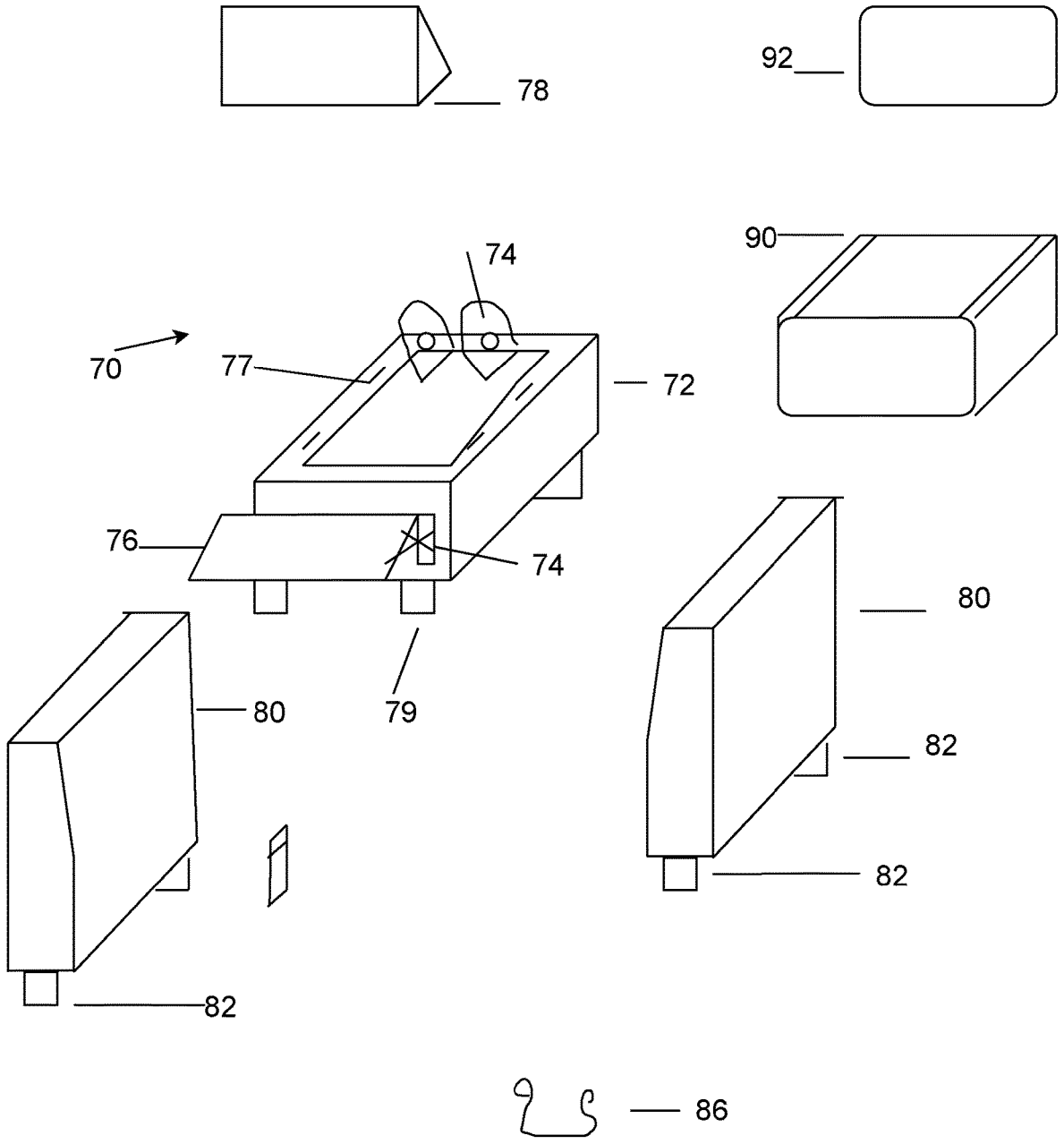
FIG. 11 is three-dimensional schematic diagram illustrating an exploded view of a manner by which of an embodiment of a furniture assembly comprising a recliner furniture module and a plurality of transverse furniture modules are coupled via a plurality of feet, a plurality of clips, and a plurality of connecting members.

FIG. 11 is three-dimensional schematic diagram illustrating an exploded view of a manner by which of an embodiment of a furniture assembly comprising a recliner furniture module and a plurality of transverse furniture modules are coupled via a plurality of feet, a plurality of clips, and a plurality of connecting members. Recliner module 70 includes a frame assembly 72, a recliner mechanism 74 mounted within the frame assembly of the recliner module, a footrest assembly 76 coupled to the recliner mechanism, and backrest 78 configured to be coupled to the recliner mechanism. The recliner mechanism 74 functions to move a top portion of the backrest 78 between upright position and a reclining position and also functions to raise the footrest between a closed position in which footrest abuts a lateral wall of the frame assembly of the recliner module and an open position in which a portion of the footrest is spaced from the frame assembly of the recliner module such that the feet of a user sitting on the recliner module are raise and lowered from a support surface on which the recliner module rest. One example of such recliner mechanism is model 35801 (Classic Metal to Floor Manual Recliner) made by Remacro-MoTion (RMT) of Suzhou, China. Other conventional recliner mechanism may be utilized, including electric driven reclining mechanisms. Feet 79 are mounted on the frame assembly of the recliner mechanisms. The frame assembly 72 of recliner module also has one or more slots 77 therein in the embodiment of FIG. 11.

Figure 12:
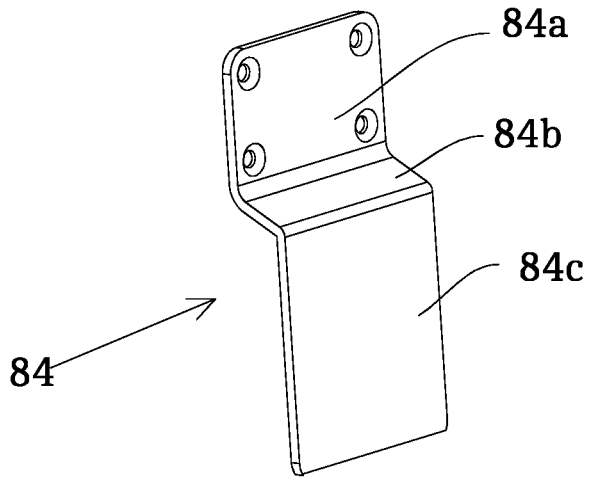
FIG. 12 is a three-dimensional schematic diagram illustrating an embodiment of a connecting member for coupling a transverse furniture module and a recliner furniture module.

Transverse module 80 has feet 82 mounted thereto. Clip 86, as described herein, is utilized to couple a foot mounted on the recliner module to a foot mounted on the transverse module to thereby couple the first module and the second module. A connecting member 84, as further described herein and with reference to FIG. 12, is mounted on the transverse furniture module and inserted into a slot in a seating surface of the frame assembly of the recliner furniture module to additionally couple the transverse module to the recliner module. Seat cushion 90 and back cushion 92 may be provided for placement on the recliner module in order to provide comfortable surfaces for a user to sit on and lean against.

FIG. 12 is a three-dimensional schematic diagram illustrating an embodiment of a connecting member for coupling a transverse furniture module and a recliner furniture module. Connecting member 84 includes a first elongate portion 84*a*, a second elongate portion 84*b*, and a linking portion 84*c*. The first elongate portion of the connecting member is configured for mounting on a lateral wall of a transverse furniture module. Toward that end, the first elongate portion 84*a* of the connecting member may include mounting holes to accept a screw or nail in one embodiment. Other means may be utilized to mount the first elongate portion of the connecting member to the lateral wall of the transverse module. For example, the first elongate portion of the connecting member may include integral spurs that are hammered into the lateral wall of the transverse module to mount the connecting member thereon. The second elongate portion 84*c* of the connecting member is configured for insertion into the slot of the seating surface of a recliner furniture module. The linking portion 84*b* (e.g., an intermediate portion) of the connecting member extends between the first elongate portion of the connecting member and the second elongate portion of the connecting member. The linking portion of the connecting member spaces the first elongate portion of the connecting member from the second elongate portion of the connecting member. As illustrated, in one embodiment, the length of the connecting member is greater than the length of the first elongate portion of the connecting member and the length of the second elongate portion of the connecting member. That is; the length of the connecting member is greater than the length of either the first elongate portion of the connecting member or second elongate portion of the connecting member. In one embodiment, the first elongate portion of the connecting member and the second elongate portion of the connecting member extend from the linking portion in different directions (e.g. opposite directions). In one embodiment, the connecting member is in the shape of a mirror imaged 'Z' or substantially in the shape of a mirrored 'Z".

For connection of the recliner module and transverse module via the connecting member, a consumer first mounts the first elongate portion of the connecting member to the transverse module. Alternatively, the connecting member may be factory mounted to the transverse module and the transverse module with mounted connecting member provided to the consumer. Next, the consumer lifts the transverse module and then puts the transverse module down so that the second elongate portion of the connecting member is inserted into the slot 77 (FIG. 10) in seating surface of the recliner module to complete the connection and fixation. For disconnection, the consumer need only lift the transverse module and move the transverse module to the side (away from the slot in the recliner module) to complete the disassembly of the coupling of the transverse module and the recliner module. Both connection and disconnection are convenient and quick. In addition, the mirrored Z-shape of the connecting member enables the recliner and transverse furniture modules to abut each other without a gap therebetween, which is both aesthetically and functionally (e.g., space saving) pleasing.

Figure 13A:
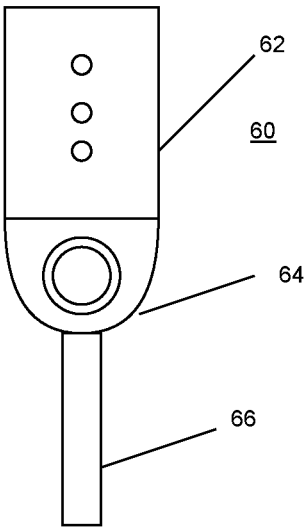
FIG. 13A is a schematic diagram illustrating a front view of an embodiment of a rotation mounting component for coupling a headrest to a backrest of a recliner module.
Figure 13B:
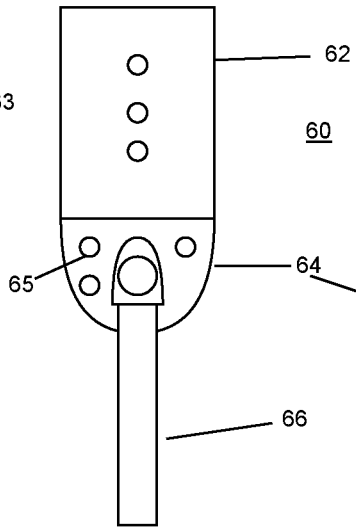
FIG. 13B is schematic diagram illustrating a back view of the embodiment of a rotation mounting component illustrated in FIG. 13A.
Figure 13C:
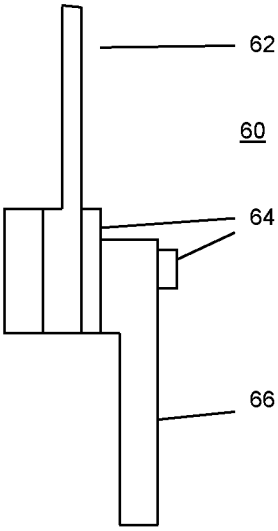
FIG. 13C is a schematic diagram illustrating a side view of the embodiment of a rotation mounting component illustrated in FIGS. 13A and 13B with the back side of FIG. 13B located to the right.

FIG. 13A-13C are schematic diagrams illustrating a front view, back view, and a side view respectively, of an embodiment of a rotation mounting component for coupling a headrest 68 to a backrest of a recliner module. Rotation mounting component comprises a first elongate member 62, a rotation mechanism 64, and a second elongate member 66. A first portion of the first elongate member 62 of the rotation mounting component is mounted to a headrest 68 and a second portion of the first elongate member of the rotation mounting component is connected to the rotation mechanism 64. Toward that end, the first portion of the first elongate portion 62 of the rotation mounting component may include mounting holes 63 to accept a screw or nail in one embodiment. Other means may be utilized to mount the first portion of the first elongate portion of the rotation mounting component to a frame assembly of the headrest. For example, the first elongate portion of the rotation mounting component may include integral spurs that are hammered into the frame assembly of the headrest to mount the rotation mounting component thereon. A first portion of the second elongate member 66 of the rotation mounting component 60 is connected to the rotation mechanism 64 and a second portion of the second elongate member of the rotation mounting component is configured for insertion into an aperture of a frame assembly of the backrest (not shown). In one embodiment, the rotation mechanism is configured to lock the first elongate member in a plurality of positions relative to the second elongate member.

Figure 13D:
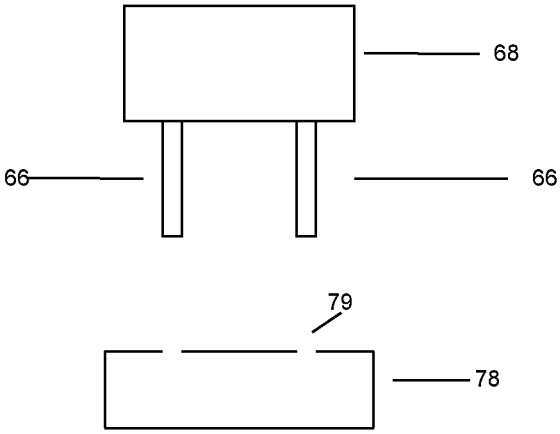
FIG. 13D is a schematic diagram illustrating an exploded view of a manner by which an headrest is coupled to a backrest of a recliner module via a plurality of rotation mounting components.

FIG. 13D is a schematic diagram illustrating an exploded view of a manner by which a headrest is coupled to a backrest of a recliner module via a plurality rotation mounting components. A first portion of a first elongate member of the rotation mounting component is mounted to a headrest 68 and a second portion of the first elongate member of the rotation mounting component is connected to a rotation mechanism. In one embodiment, the first elongate member of the rotation mounting component and the rotation mechanism are disposed within a frame assembly of the headrest 68. A first portion of a second elongate member of the rotation mounting component is connected to the rotation mechanism and a second portion of the second elongate member 66 of the rotation mounting component is configured for insertion into an aperture 79 of a frame assembly of the backrest 78 to thereby couple the headrest to the backrest of the recliner module.

It should be noted that in the description above, the term "at least one" refers to one or more than one, unless expressly defined otherwise. In addition, the terms "first,"

"second," "third," etc. are used for descriptive purposes only and should not be construed to indicate or imply relative importance.

While various embodiments have been described above, it should be understood that they have been presented by way of example only, and not limitation. Thus, the breadth and scope of a preferred embodiment should not be limited by any of the above-described exemplary embodiments, but should be defined only in accordance with the following claims and their equivalents.

What is claimed is:

1. An item of furniture comprising:

a first module, wherein the first module is a recliner module, the recliner module comprising:

a frame assembly;

a recliner mechanism mounted within the frame assembly of the first module;

a footrest assembly coupled to the recliner mechanism; and a backrest configured to be coupled to the recliner mechanism;

a first foot configured to be mounted on the first module;

a second module;

a second foot configured to be mounted on the second module; and a first clip configured to couple of the first foot to the second foot when the first module with the first foot mounted thereon abuts the second module with the second foot mounted thereon to thereby couple the first module and the second module; wherein the first clip includes an elongate portion;

a first arc-shaped portion extending from a first end of the elongate portion of the first clip and curving toward a second end of the elongate portion of the first clip; and a third arc-shaped portion extending from the second end of the elongate portion of the first clip and curving toward the first end of the elongate portion of the first clip.

2. The item of furniture of claim 1, wherein the first clip further comprises:

a second arc-shaped portion extending from a first extremity of the first arc-shaped portion and curving away from the elongate portion of the first clip;

a fourth arc-shaped portion extending from a first extremity of the third arc-shaped portion and curving away from the elongate portion of the first clip.

3. The item of furniture of claim 1, further comprising:

a third module;

a third foot configured to be mounted on the third module;

a fourth foot configured to be mounted on the first module; and a second clip configured to facilitate the coupling of the third foot to the fourth foot when the third module with the third foot mounted thereon abuts the first module with the fourth foot mounted thereon to thereby couple the third module and the first module.

4. The item of furniture of claim 3, wherein the third module comprises a base module, a transverse module, or another recliner module.

5. The item of furniture of claim 1, wherein the second module comprises a base module, a transverse module, or another recliner module.

6. The item of furniture of claim 1, wherein the second module is a transverse module, wherein the transverse module comprises a frame assembly, wherein the frame assembly of the transverse module includes a lateral wall, wherein the frame assembly of the first module includes a seating surface having a slot therein, the furniture assembly further comprising:

a connecting member configured to be mounted on the lateral wall of the transverse module and extend into the slot of the seating surface of the first module to couple the transverse module to the first module.

7. The item of furniture of claim 6, wherein the connecting member comprises:

a first elongate portion configured to be mounted on the lateral wall of the transverse module;

a second elongate portion configured to be inserted into the slot of the seating surface of the recliner module; and a linking portion spacing the first elongate portion of the connecting member from the second elongate portion of the connecting member and extending therebetween.

8. The item of furniture of claim 7, wherein a length of the connecting member is greater than a length of the first elongate portion of the connecting member and a length of the second elongate portion of the connecting member.

9. The item of furniture of claim 1, wherein the backrest comprises a frame assembly having an aperture therein, the item of furniture further comprising:

a headrest;

a rotation mounting component comprising a first elongate member, wherein a first portion of the first elongate member of the rotation mounting component is mounted to the headrest;

a rotation mechanism connected to a second portion of the first elongate member of the rotation mounting component; and a second elongate member, wherein a first portion of the second elongate member is connected to the rotation mechanism, and wherein a second portion of the second elongate member of the rotation mounting component is configured for insertion into the aperture of the frame assembly of the backrest to thereby couple the headrest to the backrest.

10. The item of furniture of claim 9, wherein the rotation mechanism is configured to lock the first elongate member of the rotation mounting component in a plurality of positions relative to the second elongate member of the rotation mounting component.

11. A method of forming a furniture assembly, the method comprising:

providing a seating component of a first module, wherein the first module is a recliner module, the seating component comprising:

a frame assembly;

a recliner mechanism mounted within the frame assembly of the first module; and a footrest assembly coupled to the recliner mechanism;

providing a backrest component of the first module;

providing a first foot;

providing a second module;

providing a second foot;

providing a clip;

coupling the backrest component to the reclining mechanism;

mounting the first foot on the first module;

mounting the second foot on the second module;

positioning the first module abutting the second module; and coupling the first foot to the second foot via the clip to thereby couple the first module and the second module;

wherein the clip includes an elongate portion;

a first arc-shaped portion extending from a first end of the elongate portion of the clip and curving toward a second end of the elongate portion of the clip; and a third arc-shaped portion extending from the second end of the elongate portion of the clip and curving toward the first end of the elongate portion of the clip.

12. The method of forming a furniture assembly of claim 11, wherein each of the first foot and the second foot comprises:

a support portion having a first end configured to contact a support surface when in an upright configuration, and a clamping portion extending from a second end of the support portion, the clamping portion configured to hugged by clip, wherein a cross-section of the support portion is larger in size than a cross-section of the clamping portion.

13. The method of forming a furniture assembly of claim 11, further comprising:

providing a third module;

providing a third foot;

providing a fourth foot;

providing another clip;

mounting the third foot on the third module;

mounting the fourth foot on the first module;

positioning the third module abutting the first module; and coupling the third foot to the fourth foot via the another clip to thereby couple the third module and the first module.

14. The method of forming a furniture assembly of claim 11, wherein the second module comprises a base module, a transverse module, or another recliner module.

15. The method of forming a furniture assembly of claim 11, wherein the backrest component comprises a frame assembly having an aperture therein, the method further comprising:

providing a headrest with a rotation mounting component mounted thereto, wherein the rotation mounting component comprises:

a first elongate member, wherein a first portion of the first elongate member of the rotation mounting component is mounted to the headrest;

a rotation mechanism connected to a second portion of the first elongate member of the rotation mounting component; and a second elongate member, wherein a first portion of the second elongate member of the rotation mounting component is connected to the rotation mechanism, and wherein a second portion of the second elongate member of the rotation mounting component is configured for insertion into the aperture of the frame assembly of the backrest component; and inserting the second elongate member of the rotation mounting component into the aperture of the frame assembly of the backrest component to thereby couple the headrest to the backrest.

16. The method of forming a furniture assembly of claim 15, wherein the rotation mechanism is configured to lock the first elongate member in a plurality of positions relative to the second elongate member.

17. The method of forming a furniture assembly of claim 11, wherein the frame assembly of the first module includes a seating surface having a slot therein, wherein the second module is a transverse module, wherein the transverse module comprises a frame assembly and a connecting member mounted on a lateral wall of the frame assembly of the transverse module, wherein the connecting member is configured to extend into the slot of the seating surface of the first module, the method further comprising:

lifting the second module off a support surface on which the second module rests;

positioning the connecting member over the slot in the seating surface of the frame assembly of the first module;

lowering the second module whereby the connecting member is inserted into the slot in the seating surface to thereby couple the transverse module to the first module.

18. An item of furniture comprising:

a first module, wherein the first module is a recliner module, the recliner module comprising:

a frame assembly;

a recliner mechanism mounted within the frame assembly of the first module;

a footrest assembly coupled to the recliner mechanism; and a backrest configured to be coupled to the recliner mechanism;

a first foot configured to be mounted on the first module;

a second module;

a second foot configured to be mounted on the second module; and a first clip configured to couple of the first foot to the second foot when the first module with the first foot mounted thereon abuts the second module with the second foot mounted thereon to thereby couple the first module and the second module;

wherein each of the first foot and the second foot includes:

a support portion having a first end configured to contact a support surface when in an upright configuration, and a clamping portion extending from a second end of the support portion, the clamping portion configured to hugged by first clip, wherein a cross-section of the support portion is larger in size than a cross-section of the clamping portion.

* * * * *